United States Patent [19]

Lavis

[11] 3,971,239

[45] July 27, 1976

[54] LOCK

[75] Inventor: Stanley Lavis, Little Ferry, N.J.

[73] Assignee: Phelps Time Recording Lock Corporation, New York, N.Y.

[22] Filed: Feb. 7, 1975

[21] Appl. No.: 548,013

[52] U.S. Cl. ..... 70/134; 70/448; 292/337

[51] Int. Cl.[2] ..... E05B 65/06; E05B 9/00

[58] Field of Search ..... 70/134, 448; 292/337

[56] References Cited

UNITED STATES PATENTS 1,496,894 6/1924 Krautter ..... 70/448

3,154,938 11/1964 Cohen ..... 70/134

*Primary Examiner*—Paul R. Gilliam
*Assistant Examiner*—R. Moore
*Attorney, Agent, or Firm*—Jordan Bierman; Linda Bierman; Kennith J. Stempler

[57] ABSTRACT

A lock is provided having a cover and a casing in which the cover is normally removable from the lock. The casing has an opening to receive a bolt therethrough, and means on the cover to engage the bolt whereby the cover cannot be removed from the casing when the bolt is in its advanced position.

1 Claim, 7 Drawing Figures

FIG. 1
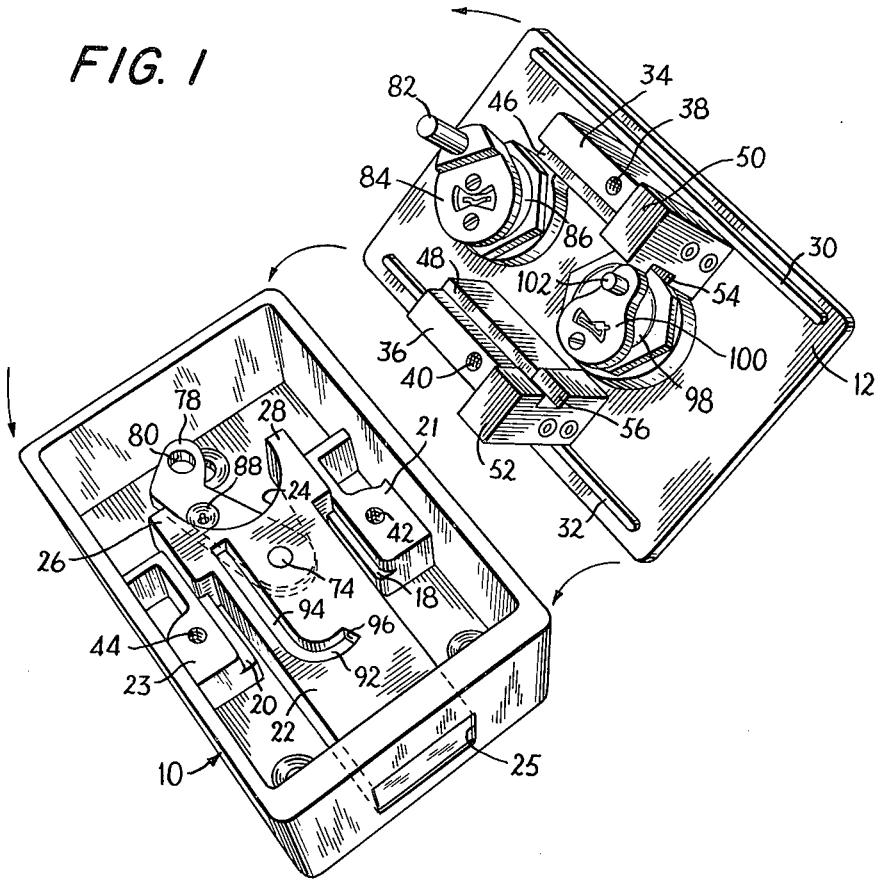
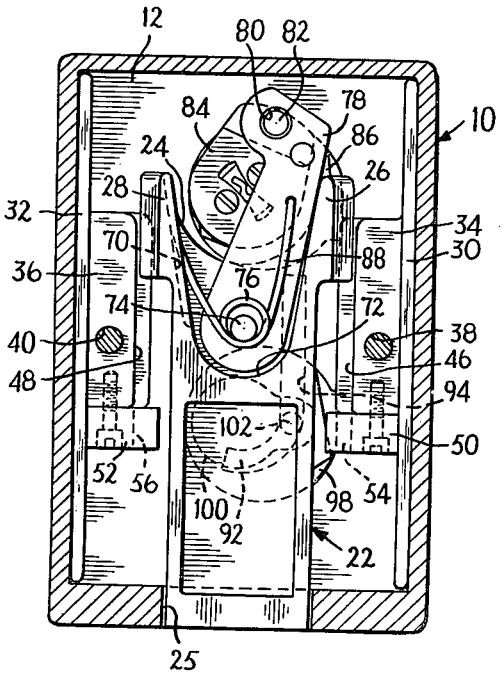
FIG. 2
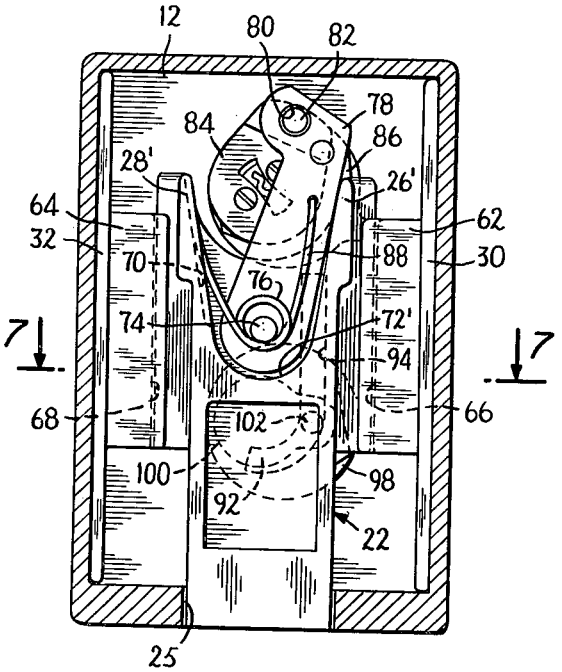
FIG. 3

LOCK

This invention relates to locks and in particular to locks of the type which have a bolt which can be advanced and retracted relative to a casing.

One of the major problems encountered with many locks today is that they can be defeated by simply removing the cover and then manually returning the latching mechanism or bolt to its unlocked or inoperative position. Some attempts have been made to prevent the removal of lock covers such as through the use of screws having portions of their heads shaved away so that the screws cannot be removed by a screwdriver. However, this is an undesirable solution since the lock cannot be easily taken apart for servicing or replacement.

In accordance with the present invention, a novel lock assembly is provided which permits the cover to be removed when the lock is in its inoperative position so that one may service the interior of the lock or remove the entire lock and replace it with a new one. The casing of the lock is provided with an opening through which a bolt moves to engage the door buck which faces the lock. Means are provided on the cover for engaging the bolt so that when the bolt extends through the opening in the casing in its advanced position, the cover, via its engagement with the bolt, cannot be removed.

Various embodiments of locks exhibiting the features of the present invention are disclosed in the drawings. The locks shown in the drawings represent an improvement of the locks shown in U.S. Pat. No. 3,154,938 to L. H. Cohen, entitled "Lock for a Sequential Locking System" and assigned to the assignee of this application. The lock shown in this patent is quite similar in construction to the locks shown in the drawings annexed to this specification, except in the area of novelty covered by this application.

The means for engaging the bolt in accordance with this invention may be made to engage the bolt only when the bolt is in its advanced position or alternatively may be made to engage the bolt at all times. Either method may be chosen, as long as the cover engages the bolt when the bolt is in its advanced position.

Other objects and advantages of the present invention will become apparent from the following detailed description and drawings in which like numerals refer to like parts in the drawings and in which various embodiments are shown.

FIG. 1 is an isometric-exploded view of a lock embodying the features of the present invention;

FIG. 2 is a plan view of the casing and cover of the lock of FIG. 1, taken along line 2—2 of FIG. 5;

FIG. 3 is a plan view of the casing and cover of the lock similar to FIG. 2 but showing a different embodiment thereof;

Figure 5:
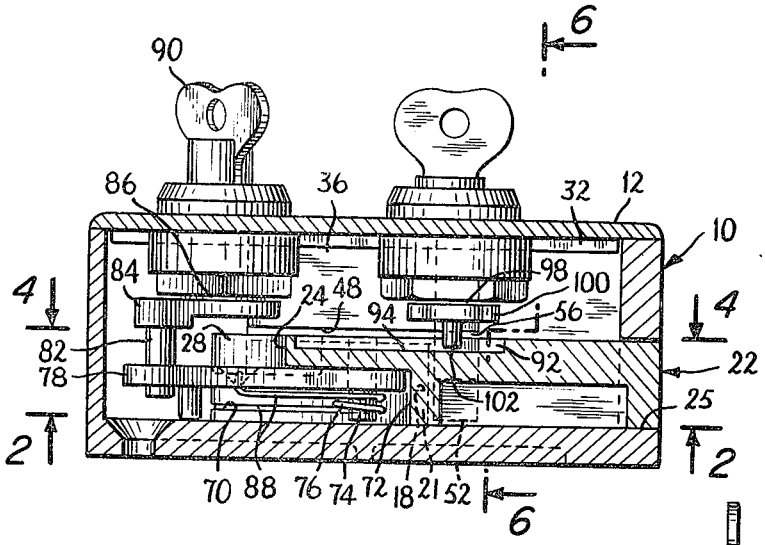
FIG. 5 is a sectional side view of the back of FIG. 1 showing the assembly of top and casing.

Referring now to the drawings, numeral 10 denotes a casing having a cover member 12 thereon. As most clearly seen in FIG. 1, cover 12 is provided with a pair of raised runners 30 and 32. The raised runners fit within the confines of casing 10 and serve to properly align the cover with respect to the casing.

Figure 4:
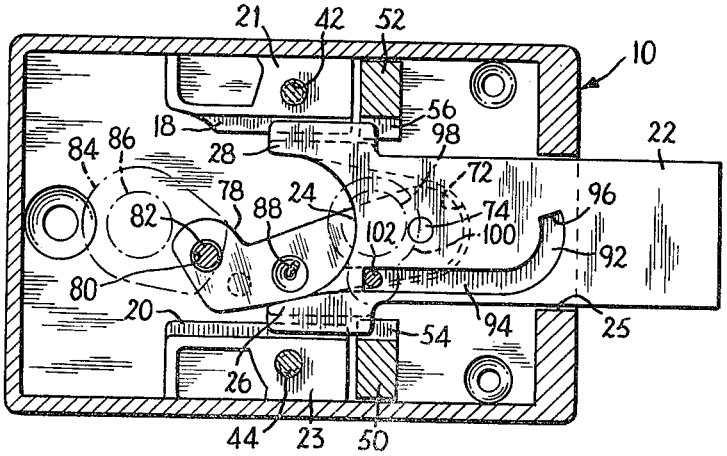
FIG. 4 is a top plan view of the casing of FIG. 1 showing the bolt in its advanced position taken along line 4—4 of FIG. 5.

The casing is provided with a pair of lugs 21 and 23 which are relieved at 18 and 20 respectively (FIG. 1). A sliding bolt 22 is mounted in the casing 10 and is adapted to be moved from the retracted position shown in FIG. 2 to an advanced position in which the bolt 22 extends through an opening 24 in casing 10 as shown in FIG. 4. As most clearly seen in FIGS. 1 and 5, the opening 24 is completely surrounded by the material of the casing so that the opening acts as a guide for the bolt 22 and as a retaining means for the cover, as will be more fully explained below.

The bolt 22 is provided with a pair of rear flanges 26 and 28 which rest on the relieved sections or ledges 18 and 20 of the lugs 21 and 23. This type of mounting for the bolt tends to assure that the bolt will be reciprocated in a straight line and will tend to prevent cocking of the bolt in the casing.

Cover 12 is provided with a pair of depending lugs 34, each of which is relieved at 46 and 48 (FIG. 1). The lug 34 and its corresponding relief 46 cooperate with lug 23 and its corresponding relief 20 to form a "tongue in groove" assembly with the rear flange 26 of the bolt 22. The same is of course true with respect to the assembly of lugs 36 and 21, along with their associated reliefs 48 and 18. Flange 28 of the bolt rides in the "groove" defined by these two lugs.

It can be readily appreciated that when the cover is placed on the casing, the bolt is substantially confined to move only in a reciprocating mode.

On the forward end of cover 12 and adjacent the depending lugs is located a pair of depending lugs or projections 50 and 52 (FIG. 2). Both projections 50 and 52 extend inwardly toward each other a distance approximately equal to the inward extension of lugs 34 and 36, and are substantially equal in depth to the combined depth of a pair of cooperating lugs i.e., the combined depth of lugs 34 and 23. Projections 50 and 52 each have recessed areas or grooves 54 and 56 respectively. The projections act substantially as a combination of lugs 21, 23, 34 and 36, the recessed areas 46, 48, 18, and 20 being continued by recessed sections or grooves 54, 56. It can be readily appreciated that the "tongue and groove" effect achieved by the pairing of the lugs and their recessed sections is continued by the grooved projections 50 and 52.

As clearly shown in the drawings, the bolt 22 is narrower than the distance between opposing lugs 21 and 23 in the casing 12. Of course, the same is true with respect to lugs 34 and 36 which depend from cover 12. The flanges 26 and 28 are positioned on the rear of the bolt and are made to fit within the grooves defined by the cooperating recesses or reliefs formed in cooperating lugs on the cover and casing. When the bolt is advanced to the position shown in FIG. 4, it extends through opening 25 in the casing, bolt flanges 26 and 28 then being in the grooves 54 and 56 in projections 50 and 52. One cannot remove the cover when the bolt is in this advanced position. Upward movement of the cover is prevented by the engagement of bolt flanges 26 and 28 with the grooves 54 and 56, and by the engagement of bolt 22 with the material of the casing through the medium of opening 25. Thus, it can be readily appreciated that the cover is rather securely anchored to the casing and cannot be removed therefrom even if the screws 38 and 40 are removed from their engagement with screw holes 42 and 44 in the casing (FIG. 1).

Figure 7:
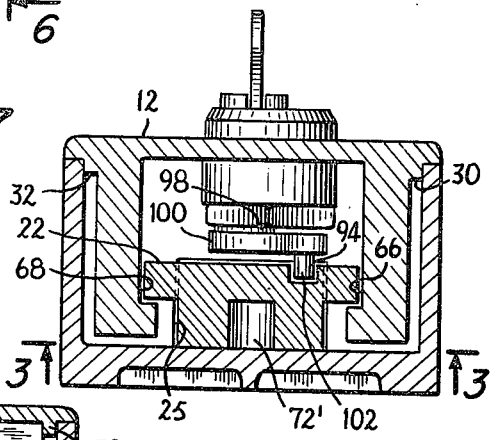
FIG. 7 is a sectional view of the embodiment shown in FIG. 3 taken along line 7—7 in FIG. 3.
Figure 6:
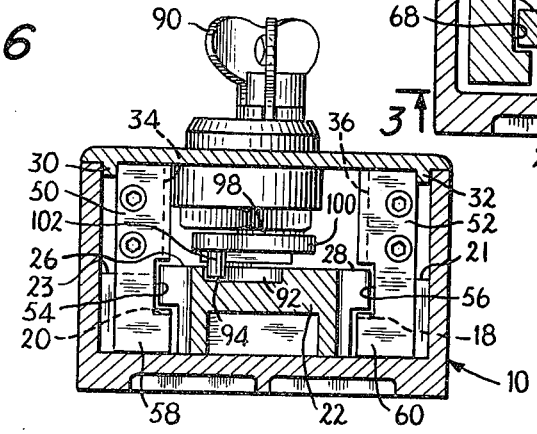
FIG. 6 is a front sectional view of the lock shown in FIG. 1 showing the assembly of top and casing taken along line 6—6 in FIG. 5.

FIGS. 1 and 2 show one embodiment of the instant invention in which projections 50 and 52 are used to engage both flanges 26 and 28 after the bolt has moved into its advanced position. FIGS. 3 and 7 show another embodiment in which the lugs 21 and 23, along with recesses 18 and 20, and projections 50 and 52, are eliminated and replaced by a pair of L-shaped projections 62 and 64 which depend from cover 12. Flanges 26 and 28 are positioned to ride above legs 67, 69 of projections 62, 64, respectively. By using the elongated projections as shown in FIGS. 3 and 7, one does not run the risk of not engaging the projections 50 and 52 as shown in FIG. 1 which might happen if the bolt is not fully moved to its advanced position. In this embodiment, the bolt and cover are first assembled together and then inserted as a unit into the casing. As in the FIG. 1 embodiment, the lock can only be assembled or disassembled when the bolt is in its retracted position. Although not necessary, the bolt may be made to retract completely into the casing in the retracted position and to completely clear the opening 25, if desired.

Remaining portions of the lock depicted in the drawings are clearly shown and described in U.S. Pat. No. 3,154,938 issued to L. H. Cohen. As is clearly seen in the drawings, the bolt at its rear has a forked section 70 which extends a selected distance into the rear of the bolt as shown at 72 in FIG. 1, and extends for somehwat lesser distance into the bolt at the other side thereof, as shown at 72' in FIG. 3. A hole 74 is placed in the plate dividing the forked sections. A pin 76, which pin is an integral part of lever 78, extends into the hole 74. The lever has a hole 80 at its other end adapted to accept an operating pin 82 which depends from a flange 84 which in turn is mounted to lock 86 (FIG. 1). Lever 78 in addition has a torsion spring 88 thereon which is anchored to the lever, surrounds the pin 76, and is then anchored in bolt flange 28. When the key 90 of lock 86 is turned, flange 84 rotates and pushes bolt 22 forwardly through opening 25 in the casing. In doing so however, lever 78 is moved from the position shown in FIG. 1 in which it is adjacent bolt flange 26 to a position adjacent bolt flange 28, against the action of torsion spring 88, and is then returned to its position adjacent flange 26. This spring action helps insure against binding of the bolt in the lock and in the casing. Upon retraction of the bolt by turning key 90 in the opposite direction, lever 78 is again moved against the pressure of spring 88 towards bolt flange 28 and then allowed to return to its rest position against bolt flange 26.

As best seen in FIGS. 1 and 4, bolt 22 is provided with a cam track 92 having a straight portion 94 which is substantially parallel to the direction of travel of the bolt, and a curved portion 96. A lock 98 having a flange 100 thereon it also provided with a depending pin 102 which pin is adapted to ride in the cam track 92. When the bolt is in its retracted position, pin 102 is positioned adjacent the point of curvature of cam track 92. If the lock is turned in a clockwise direction as viewed in FIGS. 2 and 3, the pin 102 will move into the curved portion 96 of the cam track. This pin acts as a positive locking device to prevent the bolt from being moved to its advanced position. However, if the lock 98 is moved to a position such that the pin 102 rests in the straight portion 94 of the cam track, the bolt may be moved between its advanced and retracted positions at will. This type of arrangement is eminently suitable for use in sequential locking systems of the type described in U.S. Pat. No. 3,154,938.

When the embodiment shown in FIG. 3 is used, it may be advantageous to continue cam track 94 to the end of the bolt as shown in dotted lines in FIG. 4. When the bolt is slid into the recessed areas 66, 68, the pin 102 will slide straight into cam track 94.

Many modifications of the above-described embodiments will occur to those skilled in the art. It is intended to cover all such modifications which fall within the spirit and scope of the invention as defined in the claims appended hereto.

What is claimed is:

1. A lock having a casing and a cover, a bolt mounted for sliding movement in said casing, said bolt having a pair of flanges thereon, said casing having a bolt receiving opening in one end thereof, said opening being completely surrounded by the material of the casing, said bolt being slidable between an advanced and retracted position relative to said casing, said bolt extending through said opening in said advanced position; and means on said cover for engaging the bolt to prevent removal of said cover when said bolt is in said advanced position comprising a pair of projections mounted on said cover and extending into said casing, said projections each being L-shaped, each of said flanges resting in a different one of said L-shaped projections at least when said bolt is in the advanced position, said cover being locked to said casing by the projections and by the engagement of the bolt with the casing in the advanced position of said bolt said projection engaging the bolt in both the advanced and retracted positions of the bolt.

* * * * *